US006418564B1

(12) United States Patent
Sheridan

(10) Patent No.: US 6,418,564 B1
(45) Date of Patent: Jul. 16, 2002

(54) TWO PIECE HELMET WITH OPTIONAL AIRBAG

(76) Inventor: Patrick Sheridan, 2009-1/2 Alberta, Venice, CA (US) 90291

( * ) Notice: Subject to any disclaimer, the term of this patent is extended or adjusted under 35 U.S.C. 154(b) by 0 days.

(21) Appl. No.: 09/853,010

(22) Filed: May 11, 2001

(51) Int. Cl.[7] ..... A63B 71/10
(52) U.S. Cl. ..... 2/425; 2/410
(58) Field of Search ..... 2/425, 410, 413, 2/468, 411, 421, DIG. 3, DIG. 10

(56) References Cited

U.S. PATENT DOCUMENTS

| | | | | |
|---|---|---|---|---|
| 4,291,418 | A | * | 9/1981 | Zeisler |
| 4,665,569 | A | * | 5/1987 | Santini |
| 4,977,623 | A | * | 12/1990 | DeMarco |
| 5,313,670 | A | * | 5/1994 | Archer, III |
| 5,787,513 | A | * | 8/1998 | Sharmat et al. |
| 6,032,299 | A | * | 3/2000 | Welsh |
| 6,108,824 | A | * | 8/2000 | Fournier |
| 6,138,283 | A | * | 10/2000 | Kress |
| 6,298,497 | B1 | * | 10/2001 | Chartrand |

FOREIGN PATENT DOCUMENTS

| | | | |
|---|---|---|---|
| DE | 3142962 | * | 5/1983 |
| DE | 3727701 | * | 3/1989 |
| GB | 2041724 | * | 9/1980 |
| JP | 4-370206 | * | 12/1992 |

* cited by examiner

*Primary Examiner*—Rodney M. Lindsey
(74) *Attorney, Agent, or Firm*—David A. Belasco; Belasco Jacobs & Townsley, LLP

(57) ABSTRACT

A two piece helmet with optional airbag is split along a vertical axis between the sides of the helmet to ease removal in the event of an injury. A series of aligned orifices in the helmet portions are joined by a removable cable. The cable ends are attached to each other to secure the helmet portions or to each of the helmet portions. The cable is accessed through removable panels that may also be used to tension the cable. Alternate means for joining the helmet portions include a series of lateral exterior latches opened by the cable. The helmet liner has two overlapping portions to minimize noise and improve weather sealing. An optional inflatable air bag is fitted to a lower perimeter of the helmet. A proximity sensing system will inflate the airbag when the vehicle is in motion and the helmet is displaced a certain distance from the vehicle.

17 Claims, 8 Drawing Sheets

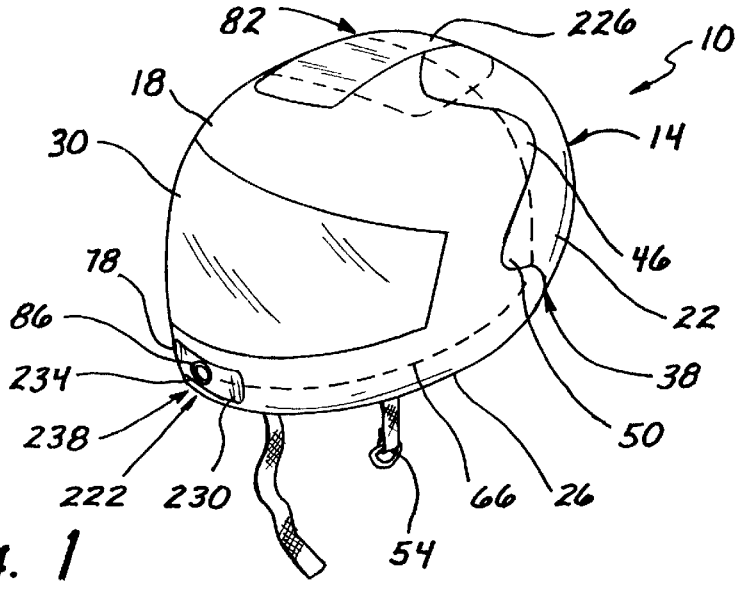
Fig. 1
Fig. 2
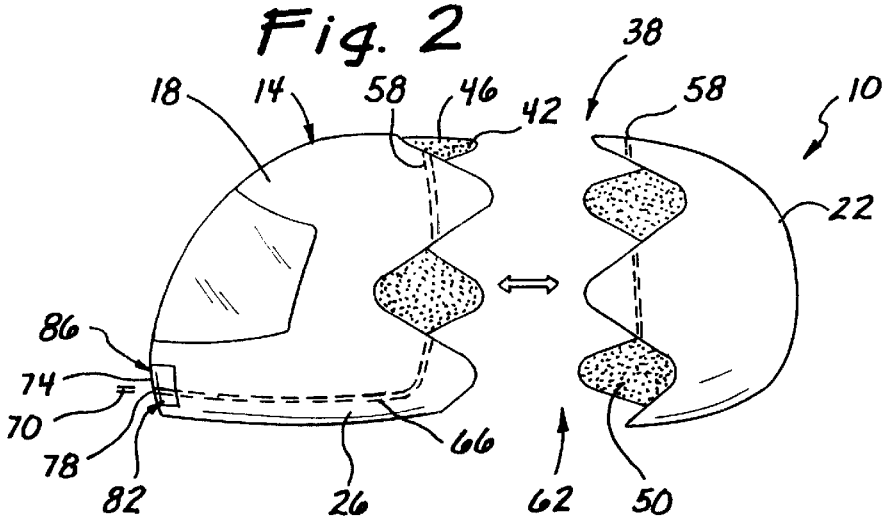
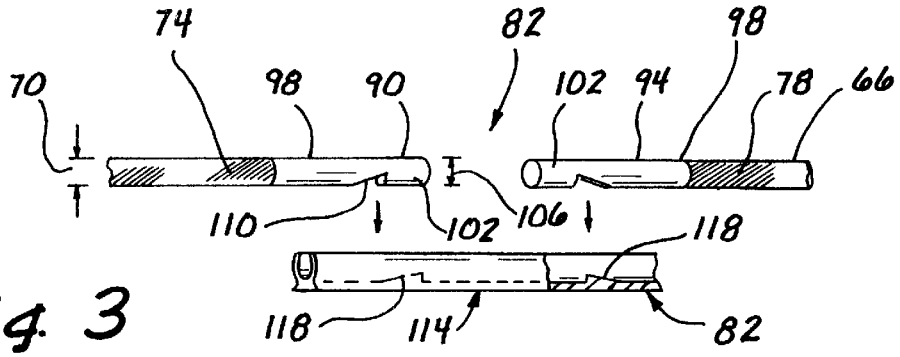
Fig. 3

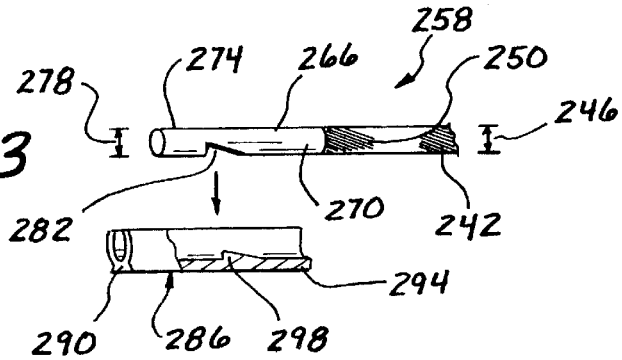
Fig. 13
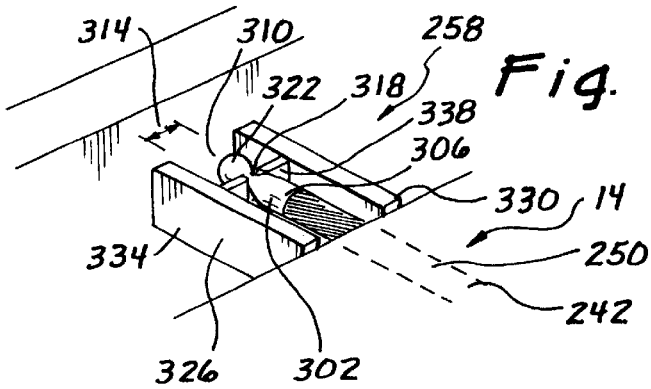
Fig. 14
Fig. 14A
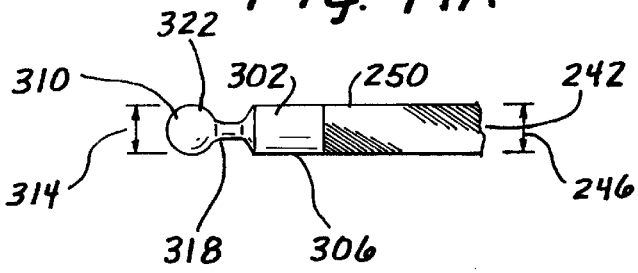
Fig. 15
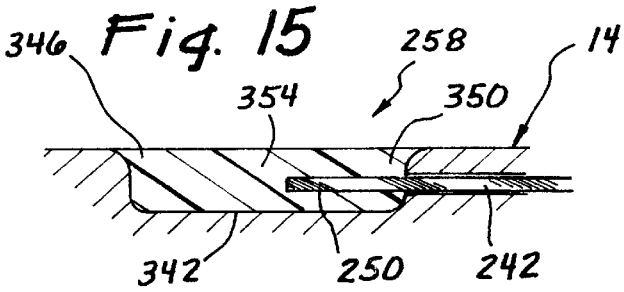

Fig. 17
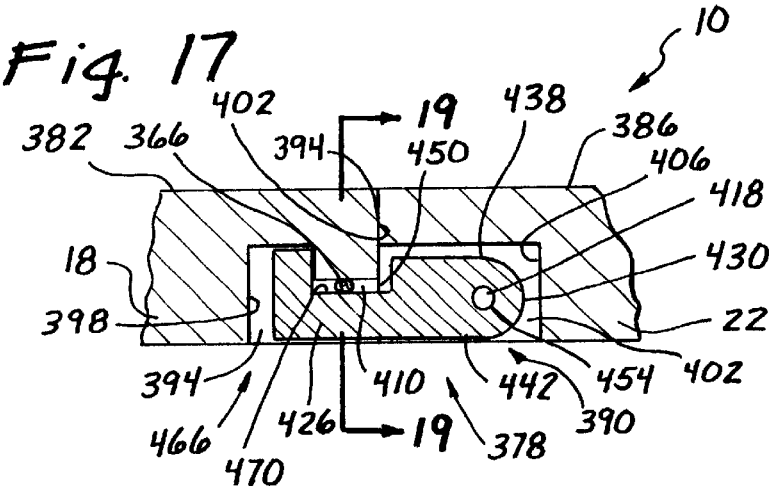
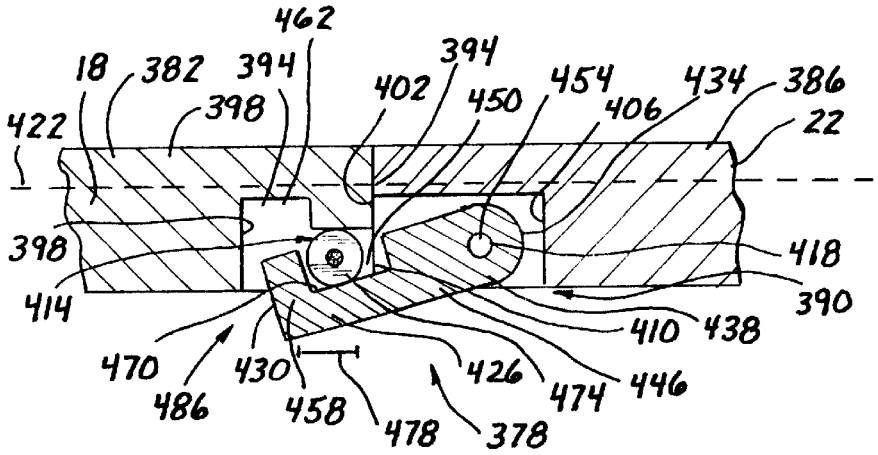
Fig. 18
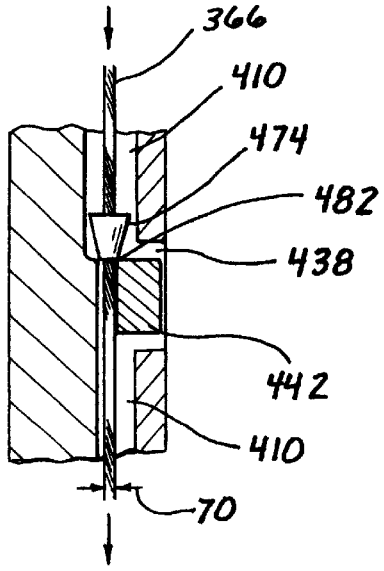
Fig. 19

TWO PIECE HELMET WITH OPTIONAL AIRBAG

FIELD OF INVENTION

The invention pertains to protective headgear. More particularly, the invention relates to helmets designed for easy removal after injury to the wearer.

BACKGROUND OF THE INVENTION

Various types of helmets have been developed for protection of the wearer. Nearly all provide some degree of cushioning from impacts and shock resistance and many incorporate novel systems to provide for ease of removal. U.S. Pat. No. 5,787,513 issued to Sharmat et al provides for a helmet that splits along a vertical axis, having a hinge at the top portion of the helmet and fastening means at either side.

U.S. Pat. No. 3,987,495 issued to Holley, discloses a motorcycle helmet designed to split along a central vertical plane running from the front to the rear of the helmet. The design is intended to provide a helmet that can be easily stored in a narrow space, such as a motorcycle saddlebag. U.S. Pat. No. 5,390,367, issued to Rush III discloses a one-piece helmet combined with an inflatable protective means attached to the lower circumference of the helmet. The protective means is instantly inflated upon impact with the crown of the helmet.

U.S. Pat. No. 4,324,005 is sued to Willis does not include a helmet, but rather employs a series of inflatable flaps that are inflated by a gas cylinder or manually by mouth when so desired by the wearer. U.S. Pat. No. 4,955,089 issued to Beale describes a hard hat that splits along a horizontal axis, requiring a series of fasteners along the joint between the upper and lower portions of the hard hat. U.S. Pat. No. 4,274,161 issued to Littler includes a one-piece helmet with manually inflatable collar attached to the lower circumference of the helmet. U.S. Pat. No. 5,133,084 issued to Martin discloses an inflatable safety collar that is actuated by a ripcord fastened to the vehicle of the user.

While other variations exist, the above-described designs for protective headgear are typical of those encountered in the prior art. It is an objective of the present invention to provide a helmet that will protect the wearer from impacts, punctures, crushing and abrasive forces. It is a further objective to provide a helmet that may be quickly and easily removed from the head with minimum injury to the wearer. It is a still further objective of the invention to provide a means for stabilizing the neck of the helmet wearer with respect to his head and body in the event of an accident. It is yet a further objective to provide a means to determine the appropriate time to deploy such stabilizing means based upon the relative position of the helmet wearer with respect to his vehicle. Finally, it is an objective of the invention to provide means to easily remove the stabilizing means when required for further care of the wearer.

While some of the objectives of the present invention are disclosed in the prior art, none of the inventions found include all of the requirements identified.

SUMMARY OF THE INVENTION

The present invention addresses many of the deficiencies of prior art protective headgear and satisfies all of the objectives described above.

A helmet providing the desired features may be constructed from the following components. A rigid, outer shell is provided. The outer shell includes a front portion and a mating rear portion. Each of the front and rear portions have a lower surrounding edge. The front portion includes an opening to provide forward visibility for a wearer. Means are provided for removably attaching the front portion to the rear portion. A resilient, padded inner liner is provided. The liner includes a first portion and a mating second portion. The first portion is sized and shaped to fit within the front portion of the outer shell. The second portion is sized and shaped to fit within the rear portion of the outer shell. Means are provided for securing the helmet to a head of the wearer.

In a variant of the invention, the means for removably attaching the front portion to the rear portion further includes a series of mating orifices in the front portion and in the rear portion. The orifices are located adjacent to an intersection between the front portion and the rear portion. A flexible cable is provided. The cable has a first predetermined cross-section, a first end and a second end and is sized and shaped to fit slidably through the mating orifices. The cable is threaded through the mating orifices and secures the front portion to the rear portion. Means are provided for removably attaching the first end to the second end. Means are provided for withdrawing the cable from the mating orifices. When the first end of the cable is detached from the second end, the cable may be withdrawn from the mating orifices and the front portion separated from the rear portion.

In a further variant, the means for removably attaching the first end of the cable to the second end includes first and second cable terminators. Each of the cable terminators has a first end, a second end and a cross-section no larger than the first predetermined cross-section. The first cable terminator is fixedly attached at its first end to the first end of the flexible cable and the second cable terminator is fixedly attached at its first end to the second end of the flexible cable. Each of the second ends of the first and second cable terminators includes a notch.

A retaining clip is provided. The retaining clip is formed of rigid material, has a U-shaped cross-section, is sized and shaped to fit frictionally over the cable terminators and includes a pair of protruding tabs. The tabs are sized, shaped, and located to removably engage the notches in the second ends of the terminators. When the second ends of the first and second cable terminators are placed adjacent each other and the retaining clip is pressed downwardly over the terminators, with the protruding tabs engaging the notches in the second ends of the cable terminators, the first and second cable ends will be removably attached.

In yet another variant of the invention, the means for removably attaching the first end of the cable to the second end includes first and second cable terminators. Each of the cable terminators has a first end, a second end and a cross-section no larger than the first predetermined cross-section. The first cable terminator is fixedly attached at its first end to the first end of the flexible cable and the second cable terminator is fixedly attached at its first end to the second end of the flexible cable. Each of the second ends of the first and second cable terminators includes a central stem and a securing portion attached to the stem.

A retaining clip is provided. The retaining clip is formed of rigid material, has a U-shaped cross-section, is sized and shaped to fit frictionally over the cable terminators and includes two pair of protruding tabs. The tabs are sized, shaped, and located to removably surround the central stems of the second ends of the cable terminators, drawing the securing portions of the terminators together. When the second ends of the first and second cable terminators are placed adjacent each other and the retaining clip is pressed downwardly over the terminators, with the protruding tabs surrounding the central stems of the second ends of the cable terminators, the first and second cable ends will be removably attached.

In still another variant, the means for removably attaching the first end of the cable to the second end includes an adhesive container. The container is sized and shaped to constrain the first end of the cable in close proximity to the second end of the cable. An adhesive is provided. The adhesive is poured into the adhesive container and over the first and second ends of the cable and allowed to dry. When the adhesive has dried, the first and second ends of the cable will be removably attached until sufficient tension is directed to separate the first end of the cable from the second end of the cable and the adhesive fails to grip either of the first and second ends of the cable.

In yet another variant of the invention, the means for removably attaching the front portion to the rear portion includes a series of mating, overlapping panels. The overlapping panels are fixedly attached to the front portion and the rear portion adjacent the intersection between the front and rear portions. The mating, overlapping panels serve to increase structural strength of the helmet and provide improved weather sealing.

In yet a further variant, the first and mating second portions of the resilient, padded inner liner include mating, interlocking edges, thereby providing improved weather sealing.

In still a further variant, the helmet includes a flexible, inflatable collar. The collar is removably attached to the lower surrounding edge of the front and rear portions of the rigid shell. Means are provided for rapidly inflating the collar as are means for deflating the collar. When the collar is inflated it will provide increased stability for the head and neck of the wearer by bearing against shoulders of the wearer.

In another variant of the invention, the means for rapidly inflating the collar and the means for deflating the collar include a pressurized gas cylinder, a control valve connected to the cylinder and tubing connecting the control valve to the inflatable collar. The cylinder contains sufficient gas to fully inflate the collar. The control valve includes a pressure relief valve and is capable of maintaining pressure in the collar until the relief valve is activated. Means are provided for activating the control valve.

In yet another variant, the means for activating the control valve further includes a position sensing system. The system is capable of determining if a helmet wearer's vehicle is in motion and a relative position of the helmet with respect to the vehicle. The system is capable of opening the control valve to inflate the collar upon sensing that the wearer's vehicle is in motion and the helmet is not within a first predetermined distance of the vehicle. The head and neck of the helmet wearer will be stabilized by the inflated collar in the event the wearer is separated from the vehicle by the first predetermined distance while the vehicle is in motion.

In still another variant, the helmet further includes means for rapidly removing the flexible cable to separate the front portion of the helmet from the rear portion.

In a yet another variant of the invention, the means for rapidly removing the flexible cable includes a first removable access panel. The first access panel covers the means for removably attaching the first end of the cable to the second end and a second removable access panel covers a portion of the flexible cable and an indentation in one of the front and rear portions of the helmet. The indentation provides means to apply tension to the cable for its removal.

In a further variant, the means for removably attaching the front portion to the rear portion of the helmet further includes a series of mating orifices in the front portion and in the rear portion. The orifices are located adjacent an intersection between the front portion and the rear portion. A flexible cable is provided. The cable has a first predetermined cross-section a first end and a second end. The cable is sized and shaped to fit slidably through the mating orifices. The cable is threaded through the mating orifices and secures the front portion to the rear portion. Means are provided for removably attaching the first end to either of the front and rear portions of the rigid, outer shell. Means are provided for applying tension to the second end of the cable and withdrawing the cable from the mating orifices. When the first end of the cable is detached from the shell, the cable may be withdrawn from the mating orifices and the front portion separated from the rear portion.

In still a further variant, the means for removably attaching the first end of the cable to rigid, outer shell includes a cable terminator. The cable terminator has a first end, a second end and a cross-section no larger than the first predetermined cross-section. The cable terminator is fixedly attached at its first end to the first end of the flexible cable. The second end of the cable terminator includes a notch.

A retaining clip is provided. The retaining clip has a first end and a second end. The retaining clip is fixedly attached at its first end to the rigid outer shell. The retaining clip is formed of rigid material, has a U-shaped cross-section, is sized and shaped to fit frictionally about the cable terminator. The retaining clip includes a pair of protruding tabs. The tabs are sized, shaped, and located to removably engage the notch in the second end of the terminator. When the cable terminator is pressed into the second end of the retaining clip, with the protruding tabs engaging the notch in the second end of the cable terminator, the first end of the cable will be removably attached to the shell.

In another variant of the invention, the means for removably attaching the first end of the cable to the rigid, outer shell includes a cable terminator. The cable terminator has a first end, a second end and a cross-section no larger than the first predetermined cross-section. The cable terminator is fixedly attached at its first end to the first end of the flexible cable. The second end of the cable terminator includes a central stem and a securing portion attached to the stem.

A retaining clip is provided. The retaining clip has a first end and a second end. The retaining clip is fixedly attached at its first end to the rigid outer shell. The retaining clip is formed of rigid material, has a U-shaped cross-section, is sized and shaped to fit frictionally about the cable terminator. The retaining clip includes a pair of protruding tabs. The tabs are sized, shaped, and located to removably surround the central stem of the second end of the cable terminator. When the cable terminator is pressed into the second end of the retaining clip, with the protruding tabs surrounding the central stem of the second end of the cable terminator, the first end of the cable will be removably attached to the shell.

In still another variant, the means for removably attaching the first end of the cable to the rigid, outer shell includes an adhesive container. The container has a first end and a second end and is fixedly attached at its first end to the rigid, outer shell. The second end of the container is sized and shaped to constrain the first end of the cable. An adhesive is provided. The adhesive is poured into the second end of the adhesive container and over the first end of the cable and allowed to dry. When the adhesive has dried, the first end of the cable will be removably attached to the rigid, outer shell until sufficient tension is directed to the second end of the cable to separate the first end of the cable from the adhesive container, thereby permitting removal of the cable from the helmet.

In yet another variant, the means for removably attaching the front portion of the helmet to the rear portion includes a series of mating orifices in the front portion and in the rear portion. The orifices are located adjacent an intersection between the front portion and the rear portion. A flexible cable is provided. The cable has a first predetermined cross-section, a first end and a second end and is sized and shaped to fit slidably through the mating orifices.

At least one securing latch is provided. The securing latch has a first portion, a mating second portion and means for removably attaching the first portion to the second portion, thereby securing the front portion of the helmet to the rear portion. The first portion has an inner end and an outer end and is fixedly attached to the front portion of the shell. The second portion has an inner end and an outer end and is fixedly attached to the rear portion of the shell. The first and second portions including mating openings that are collinear when the first portion is located adjacent the second portion. The cable is threaded through the mating orifices and the mating openings. The cable includes means for unfastening the means for removably attaching the first portion of the securing latch to the second portion.

Means are provided for removably attaching the first end of the cable to the rigid shell as are means for withdrawing the cable from the mating orifices and the mating openings. When the first end of the cable is detached from the rigid shell, the cable may be withdrawn from the mating orifices and the mating openings, thereby unfastening the means for removably attaching the first portion of the securing latch to the second portion and permitting the front portion of the helmet to be separated from the rear portion.

In still another variant of the invention, the means for removably attaching the first portion of the securing latch to the second portion and the means for unfastening the means for removably attaching the first portion of the securing latch to the second portion includes a pivot pin. The pivot pin is fixedly attached to the second portion between its inner end and its outer end perpendicular to a long axis of the second portion. A latching element is provided. The latching element has a first end, a second end, a first edge, a second edge, a top surface, a bottom surface and an orifice extending from the first edge to the second edge. The latching element is rotatably mounted at the orifice to the pivot pin.

A resilient engaging finger is provided. The finger extends downwardly from the bottom surface of the latching element. A receiving notch is provided. The notch is located in the first portion between its inner end and its outer end so as to frictionally engage the resilient finger when the latching element is rotated to a first, closed position. An unfastening protrusion extends downwardly from the bottom surface of the latching element and is located to obscure a portion of the mating openings when the latching element is rotated to the first, closed position.

A dislodging element is provided. The dislodging element has a cross-section greater that the first predetermined cross-section, and is capable of fitting slidably within the mating openings in the securing latch. The dislodging element is fixedly attached to the flexible cable at a point where the dislodging element will pass through the mating openings of the securing latch when the cable is withdrawn from the helmet. The dislodging element bears upon the unfastening protrusion as the cable is withdrawn from the helmet, thereby causing the latching element to pivot upwardly to a second, open position dislodging the resilient engaging finger from the receiving notch. This permits the first portion of the securing latch to be separated from the second portion and the front portion of the helmet to be separated from the rear portion.

In a final variant of the invention, the first removable access panel further includes at least one tensioning element. The tensioning element is attached to an underside of the first access panel and is sized, shaped and located to engage a portion of the flexible cable. The tensioning element imparts tension to the cable while securing the first access panel to the helmet.

An appreciation of the other aims and objectives of the present invention and an understanding of it may be achieved by referring to the accompanying drawings and the detailed description of a preferred embodiment.

DESCRIPTION OF THE DRAWINGS

FIG. 1 is a perspective view of the preferred embodiment of the invention;

FIG. 2 is an exploded perspective view of the preferred embodiment of the invention illustrating the front and rear portions of the helmet and the flexible cable joining them;

FIG. 3 is a detailed perspective view of the first and second cable ends, cable terminators and the retaining clip attaching the terminators together;

FIG. 13 is an exploded perspective view of an alternative embodiment of the invention, illustrating the first end of the flexible cable being attached to the helmet and the second end being attached to a means for applying tension to the second end;

FIG. 14 is a detailed perspective view of the means for attaching the first end of the cable to the helmet;

FIG. 14A is detailed side view of an end of a second embodiment of a flexible cable;

FIG. 15 is a detailed perspective view of a first alternative means for attaching the first end of the cable to the helmet;

FIG. 17 is an perspective view of an alternative embodiment of the invention, illustrating a securing latch for attaching the front portion to the rear portion of the helmet; and FIG. 18 is a detailed perspective view of the securing latch in open position as activated by the flexible cable; and FIG. 19 is a detailed perspective view of the securing latch in closed position.

DETAILED DESCRIPTION OF THE PREFERRED EMBODIMENT

Figure 4:
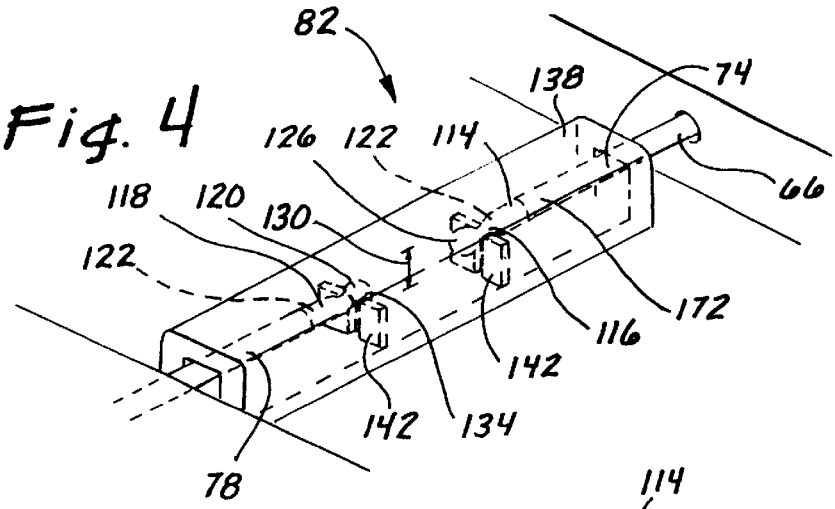
FIG. 4 is a detailed perspective view of a second embodiment of the first and second cable ends, cable terminators and the retaining clip attaching the terminators together.
Figure 4A:
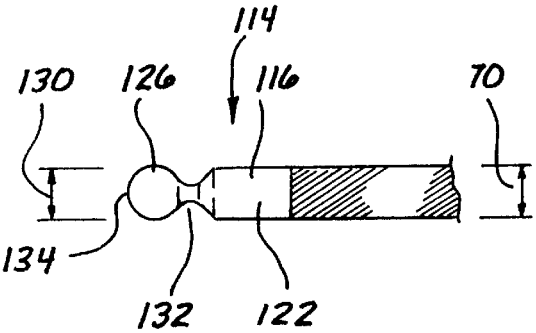
FIG. 4A is detailed side view of an end of a first embodiment of a flexible cable.

FIGS. 1 and 2 illustrate a helmet 10 providing the desired features that may be constructed from the following components. A rigid, outer shell 14 is provided. The outer shell 14 includes a front portion 18 and a mating rear portion 22. Each of the front 18 and rear 22 portions have a lower surrounding edge 26. The front portion 18 includes an opening 30 to provide forward visibility for a wearer 34. Means 38 are provided for removably attaching the front portion 18 to the rear portion 22. A resilient, padded inner liner 42 is provided. The liner 42 includes a first portion 46 and a mating second portion 50. The first portion 46 is sized and shaped to fit within the front portion 18 of the outer shell 14. The second portion 50 is sized and shaped to fit within the rear portion 22 of the outer shell 14. Means 54 are provided for securing the helmet 10 to the head 32 of the wearer 34.

In a variant of the invention, illustrated in FIG. 2, the means 38 for removably attaching the front portion 18 to the rear portion 22 further includes a series of mating orifices 58 in the front portion 18 and in the rear portion 22. The orifices 58 are located adjacent to an intersection 62 between the front portion 18 and the rear portion 22. A flexible cable 66 is provided. The cable 66 has a first predetermined cross-section 70, a first end 74 and a second end 78 and is sized and shaped to fit slidably through the mating orifices 58. The cable 66 is threaded through the mating orifices 58 and secures the front portion 18 to the rear portion 22. Means 82 are provided for removably attaching the first end 74 to the second end 78. Means 86 are provided for withdrawing the cable 66 from the mating orifices 58. When the first end 74 of the cable 66 is detached from the second end 78, the cable 66 may be withdrawn from the mating orifices 58 and the front portion 18 separated from the rear portion 22.

In a further variant, illustrated in FIG. 3, the means 82 for removably attaching the first end 74 of the cable 66 to the second end 78 includes first 90 and second 94 cable terminators. Each of the cable terminators 90, 94 has a first end 98, a second end 102 and a cross-section 106 no larger than the first predetermined cross-section 70. The first cable terminator 90 is fixedly attached at its first end 98 to the first end 74 of the flexible cable 66 and the second cable terminator 94 is fixedly attached at its first end 98 to the second end 78 of the flexible cable 66. Each of the second ends 102 of the first 90 and second 94 cable terminators includes a notch 110.

A retaining clip 114 is provided. The retaining clip 114 is formed of rigid material, has a U-shaped cross-section, is sized and shaped to fit frictionally over the cable terminators 90, 94 and includes a pair of protruding tabs 118. The tabs 118 are sized, shaped, and located to removably engage the notches 110 in the second ends 102 of the terminators 90, 94. When the second ends 102 of the first 90 and second 94 cable terminators are placed adjacent each other and the retaining clip 114 is pressed downwardly over the terminators 90, 94, with the protruding tabs 118 engaging the notches 110 in the second ends 102 of the cable terminators 90, 94, the first 74 and second 78 cable ends will be removably attached.

In yet another variant of the invention, illustrated in FIG. 4, the means 82 for removably attaching the first end 74 of the cable 66 to the second end 78 includes first 114 and second 118 cable terminators. Each of the cable terminators 114, 118 has a first end 122, a second end 126 and a cross-section 130 no larger than the first predetermined cross-section 70. The first cable terminator 114 is fixedly attached at its first end 122 to the first end 74 of the flexible cable 66 and the second cable terminator 118 is fixedly attached at its first end 122 to the second end 78 of the flexible cable 66. Each of the second ends 126 of the first 114 and second 118 cable terminators includes a central stem 132 and a securing portion 134 attached to the stem 132.

A retaining clip 138 is provided. The retaining clip 138 is formed of rigid material, has a U-shaped cross-section, is sized and shaped to fit frictionally over the cable terminators 114, 118 and includes two pair of protruding tabs 142. The tabs 142 are sized, shaped, and located to removably surround the central stems 132 of the second ends 126 of the cable terminators, drawing the securing portions 134 of the terminators together. When the second ends 126 of the first 114 and second 118 cable terminators are placed adjacent each other and the retaining clip 138 is pressed downwardly over the terminators 114, 118, with the protruding tabs 142 surrounding the central stems 130 of the second ends 126 of the cable terminators 114, 118, the first 74 and second 78 cable ends will be removably attached.

Figure 5:
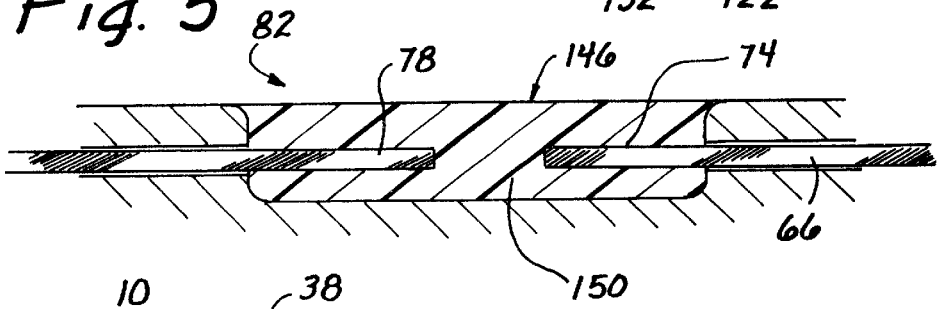
FIG. 5 is a detailed perspective view of a third embodiment of the first and second cable ends, cable terminators and the retaining clip attaching the terminators together.

In still another variant, illustrated in FIG. 5, the means 82 for removably attaching the first end 74 of the cable 66 to the second end 78 includes an adhesive container 146. The container 146 is sized and shaped to constrain the first end 74 of the cable 66 in close proximity to the second end 78 of the cable 66. An adhesive 150 is provided. The adhesive 150 is poured into the adhesive container 146 and over the first 74 and second 78 ends of the cable 66 and allowed to dry. When the adhesive 150 has dried, the first 74 and second 78 ends of the cable 66 will be removably attached until sufficient tension is directed to separate the first end 74 of the cable 66 from the second end 78 of the cable 66 and the adhesive 150 fails to grip either of the first 74 and second 78 ends of the cable 66.

Figure 6:
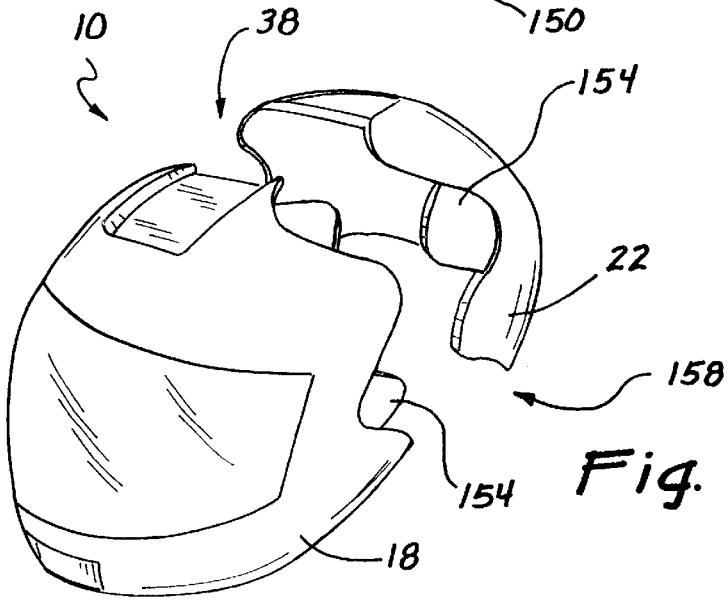
FIG. 6 is a perspective view of the mating, overlapping panels attached to the front and rear portions of the helmet.

In yet another variant of the invention, illustrated in FIG. 6, the means 38 for removably attaching the front portion 18 to the rear portion 22 includes a series of mating, overlapping panels 154. The overlapping panels 154 are fixedly attached to the front portion 18 and the rear portion 22 adjacent the intersection 158 between the front 18 and rear 22 portions. The mating, overlapping panels 154 serve to increase structural strength of the helmet 10 and provide improved weather sealing.

Figure 7:
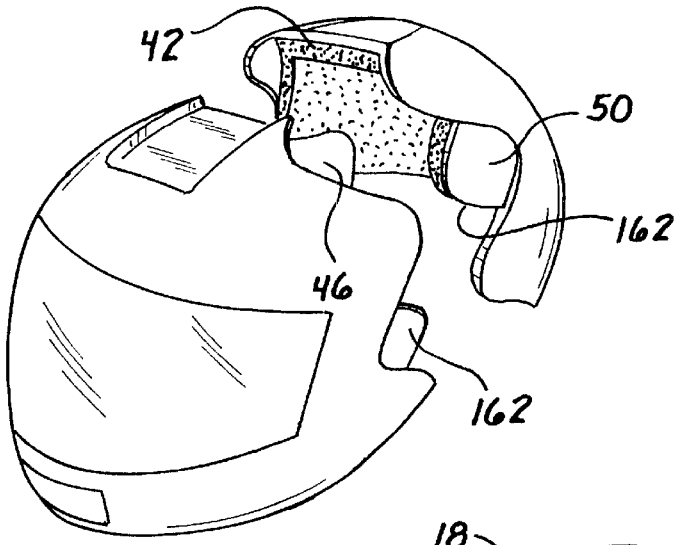
FIG. 7 is a perspective view of the mating, first and second portions of the resilient, padded inner liner of the helmet.

In yet a further variant, illustrated in FIG. 7, the first 46 and mating second 50 portions of the resilient, padded inner liner 42 include mating, interlocking edges 162, thereby providing improved weather sealing.

Figure 8:
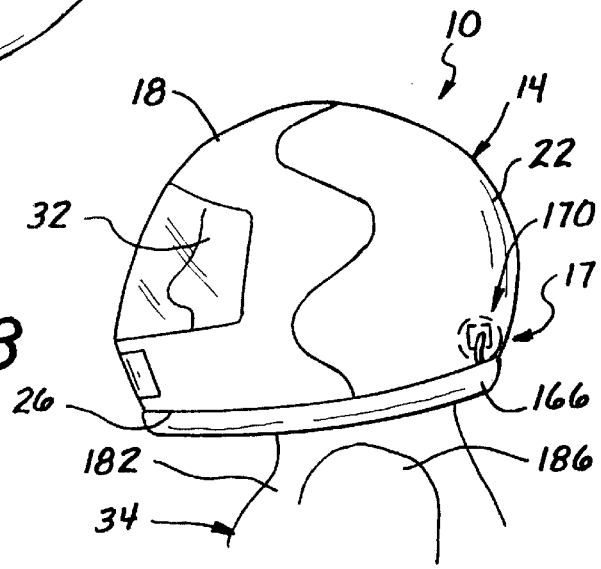
FIG. 8 is a perspective view of the FIG. 1 embodiment further including a flexible inflatable collar attached to the lower surrounding edge of the front and rear portions of the shell.

In still a further variant, illustrated in FIG. 8, the helmet 10 includes a flexible, inflatable collar 166. The collar 166 is removably attached to the lower surrounding edge 26 of the front 18 and rear 22 portions of the rigid shell 14. Means 170 are provided for rapidly inflating the collar 166 as are means 174 for deflating the collar 166. When the collar 166 is inflated it will provide increased stability for a head 32 and neck 182 of the wearer 34 by bearing against shoulders 186 of the wearer 34.

Figure 9:
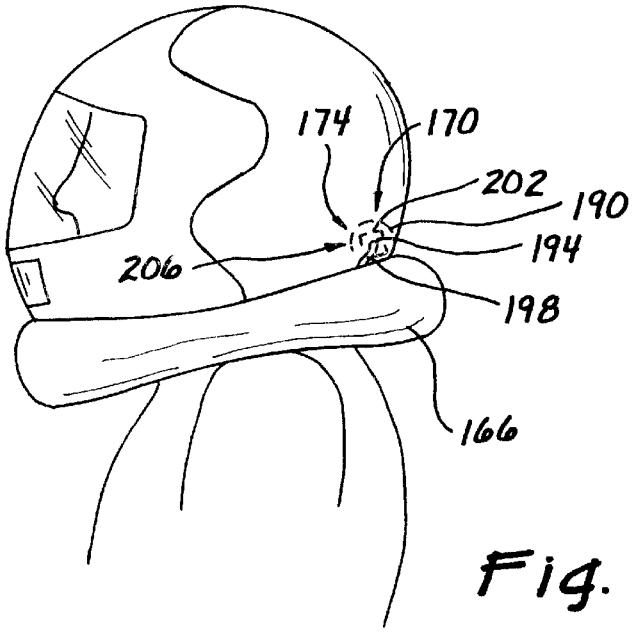
FIG. 9 is a cutaway perspective view of the FIG. 8 embodiment illustrating the pressurization and control mechanisms for the helmet.

In another variant of the invention, illustrated in FIG. 9, the means 170 for rapidly inflating the collar 166 and the means 174 for deflating the collar 166 include a pressurized gas cylinder 190, a control valve 194 connected to the cylinder 190 and tubing 198 connecting the control valve 194 to the inflatable collar 166. The cylinder 190 contains sufficient gas to fully inflate the collar 166. The control valve 194 includes a pressure relief valve 202 and is capable of maintaining pressure in the collar 166 until the relief valve 202 is activated. Means 206 are provided for activating the control valve 194.

Figure 10A:
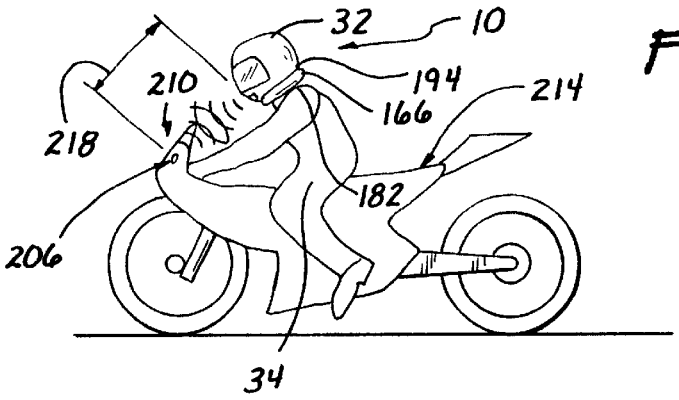
FIG. 10A is a perspective view of the FIG. 8 embodiment in conjunction with a wearer and a motorcycle illustrating the helmet proximity sensing system with the wearer properly mounted.
Figure 10B:
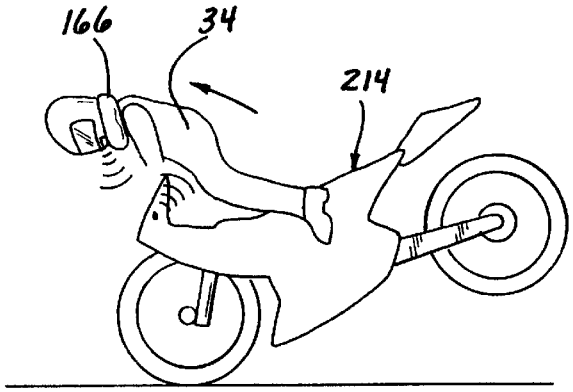
FIG. 10B is a perspective view of the FIG. 8 embodiment in conjunction with a wearer and a motorcycle illustrating the helmet proximity sensing system with the rider with the wearer dislodged so as to activate the pressurization and control mechanisms for the helmet.

In yet another variant, illustrated in FIG. 10, the means 206 for activating the control valve 194 further includes a position sensing system 210. The system 210 is capable of determining if a helmet wearer's vehicle 214 is in motion and a relative position of the helmet 10 with respect to the vehicle 214. The system 210 is capable of opening the control valve 194 to inflate the collar 166 upon sensing that the wearer's vehicle 214 is in motion and the helmet 10 is not within a first predetermined distance 218 of the vehicle 214. The head 32 and neck 182 of the helmet wearer 34 will be stabilized by the inflated collar 166 in the event the wearer 34 is separated from the vehicle 214 by the first predetermined distance 218 while the vehicle 214 is in motion.

In still another variant, illustrated in FIG. 1, the helmet 10 further includes means 222 for rapidly removing the flexible cable 66 to separate the front portion 18 of the helmet 10 from the rear portion 22.

In a yet another variant of the invention, also illustrated in FIG. 1, the means 222 for rapidly removing the flexible cable 66 includes a first removable access panel 226. The first access panel 226 covers the means 82 for removably attaching the first end 74 of the cable 66 to the second end 78 and a second removable access panel 230 covers a portion of the flexible cable 66 and an indentation 234 in the front portion 18 of the helmet 10. The indentation 234 provides means 238 to apply tension to the cable 66 for its removal.

Figure 11:
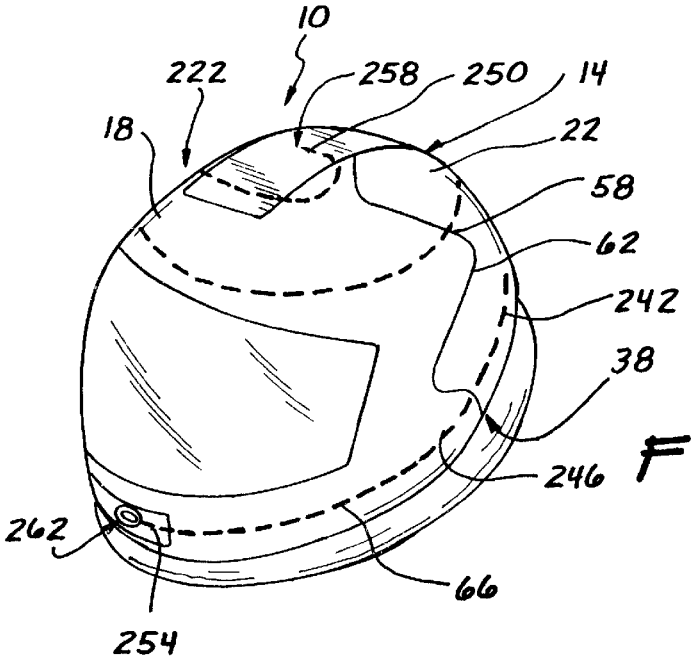
FIG. 11 is a perspective view of the FIG. 8 embodiment illustrating the flexible cable in place in the helmet.

In a further variant, illustrated in FIG. 11, the means 38 for removably attaching the front portion 18 to the rear portion 22 of the helmet 10 further includes a series of mating orifices 58 in the front portion 18 and in the rear portion 22. The orifices 58 are located adjacent an intersection 62 between the front portion 18 and the rear portion 22. A flexible cable 242 is provided. The cable 242 has a first predetermined cross-section 246, a first end 250 and a second end 254. The cable 242 is sized and shaped to fit slidably through the mating orifices 58. The cable 242 is threaded through the mating orifices 58 and secures the front portion 18 to the rear portion 22. Means 258 are provided for removably attaching the first end 250 to either of the front 18 and rear 22 portions of the rigid, outer shell 14. Means 262 are provided for applying tension to the second end 254 of the cable 242 and withdrawing the cable 242 from the mating orifices 58. When the first end 250 of the cable 242 is detached from the shell 14, the cable 242 may be withdrawn from the mating orifices 58 and the front portion 18 separated from the rear portion 22.

In still a further variant, illustrated in FIG. 13, the means 258 for removably attaching the first end 250 of the cable 242 to rigid, outer shell 14 includes a cable terminator 266. The cable terminator 266 has a first end 270, a second end 274 and a cross-section 278 no larger than the first predetermined cross-section 70. The cable terminator 266 is fixedly attached at its first end 270 to the first end 250 of the flexible cable 242. The second end 274 of the cable terminator 266 includes a notch 282.

A retaining clip 286 is provided. The retaining clip 286 has a first end 290 and a second end 294. The retaining clip 286 is fixedly attached at its first end 290 to the rigid outer shell 14. The retaining clip 286 is formed of rigid material, has a U-shaped cross-section, and is sized and shaped to fit frictionally about the cable terminator 266. The retaining clip 286 includes a pair of protruding tabs 298. The tabs 298 are sized, shaped, and located to removably engage the notch 282 in the second end 274 of the terminator 266. When the cable terminator 266 is pressed into the second end 294 of the retaining clip 266, with the protruding tabs 298 engaging the notch 282 in the second end 274 of the cable terminator 266, the first end 250 of the cable 242 will be removably attached to the shell 14.

In another variant of the invention, illustrated in FIG. 14, the means 258 for removably attaching the first end 250 of the cable 242 to the rigid, outer shell 14 includes a cable terminator 302. The cable terminator 302 has a first end 306, a second end 310 and a cross-section 314 larger than the first predetermined cross-section 70. The cable terminator 302 is fixedly attached at its first end 306 to the first end 250 of the flexible cable 242. The second end 310 of the cable terminator 302 includes a central stem 318 and a securing portion 322 attached to the stem 318.

A retaining clip 326 is provided. The retaining clip 326 has a first end 330 and a second end 334. The retaining clip 326 is fixedly attached at its first end 330 to the rigid outer shell 14. The retaining clip 326 is formed of rigid material, has a U-shaped cross-section, is sized and shaped to fit frictionally about the cable terminator 302. The retaining clip 326 includes a pair of protruding tabs 338. The tabs 338 are sized, shaped, and located to removably surround the central stem 318 of the second end 306 of the cable terminator 302. When the cable terminator 302 is pressed into the second end 334 of the retaining clip 326, with the protruding tabs 338 surrounding the central stem 318 of the second end 306 of the cable terminator 302, the first end 250 of the cable 242 will be removably attached to the shell 14.

In still another variant, illustrated in FIG. 15, the means 258 for removably attaching the first end 250 of the cable 242 to the rigid, outer shell 14 includes an adhesive container 342. The container 342 has a first end 346 and a second end 350 and is fixedly attached at its first end 346 to the rigid, outer shell 14. The second end 350 of the container 342 is sized and shaped to constrain the first end 250 of the cable 242. An adhesive 354 is provided. The adhesive 354 is poured into the second end 350 of the adhesive container 342 and over the first end 250 of the cable 242 and allowed to dry. When the adhesive 354 has dried, the first end 250 of the cable 242 will be removably attached to the rigid, outer shell 14 until sufficient tension is directed to the second end 254 of the cable 242 to separate the first end 250 of the cable 242 from the adhesive container 342, thereby permitting removal of the cable 242 from the helmet 10.

In yet another variant, illustrated in FIG. 17, the means 38 for removably attaching the front portion 18 of the helmet 10 to the rear portion 22 includes a series of mating orifices 358 in the front portion 18 and in the rear portion 22. The orifices 358 are located adjacent an intersection 362 between the front portion 18 and the rear portion 22. A flexible cable 366 is provided. The cable 366 has a first predetermined cross-section 70, a first end 370 and a second end 374 and is sized and shaped to fit slidably through the mating orifices 358.

At least one securing latch 378 is provided. The securing latch 378 has a first portion 382, a mating second portion 386 and means 390 for removably attaching the first portion 382 to the second portion 386, thereby securing the front portion 18 of the helmet 10 to the rear portion 22. The first portion 382 has an inner end 394 and an outer end 398 and is fixedly attached to the front portion 18 of the shell 14. The second portion 386 has an inner end 402 and an outer end 406 and is fixedly attached to the rear portion 22 of the shell 14. The first 382 and second 386 portions including mating openings 410 that are collinear when the first portion 382 is located adjacent the second portion 386. The cable 366 is threaded through the mating orifices 358 and the mating openings 410. The cable 366 includes means 414 for unfastening the means 390 for removably attaching the first portion 382 of the securing latch 378 to the second portion 386.

Means (not shown) are provided for removably attaching the first end 370 of the cable 366 to the rigid shell 14 as are means (not shown) for withdrawing the cable 366 from the mating orifices 358 and the mating openings 410. When the first end 370 of the cable 366 is detached from the rigid shell 14, the cable 366 may be withdrawn from the mating orifices 358 and the mating openings 410, thereby unfastening the means 390 for removably attaching the first portion 382 of the securing latch 378 to the second portion 386 and permitting the front portion 18 of the helmet 10 to be separated from the rear portion 22.

In still another variant of the invention, illustrated in FIG. 18, the means 390 for removably attaching the first portion 382 of the securing latch 378 to the second portion 386 and the means 414 for unfastening the means 390 for removably attaching the first portion 382 of the securing latch 378 to the second portion 386 includes a pivot pin 418. The pivot pin 418 is fixedly attached to the second portion 386 between its inner end 402 and its outer end 406 perpendicular to a long axis 422 of the second portion 386. A latching element 426 is provided. The latching element 426 has a first end 430, a second end 434, a first edge 438, a second edge 442 (not shown), a top surface 446, a bottom surface 450 and an orifice 454 extending from the first edge 438 to the second edge 442. The latching element 426 is rotatably mounted at the orifice 454 to the pivot pin 418.

A resilient engaging finger 458 is provided. The finger 458 extends downwardly from the bottom surface 450 of the latching element 426. A receiving notch 462 is provided. The notch 462 is located in the first portion 382 between its inner end 394 and its outer end 398 so as to frictionally engage the resilient finger 458 when the latching element 426 is rotated to a first, closed position 466. An unfastening protrusion 470 extends downwardly from the bottom surface 450 of the latching element 426 and is located to obscure a portion of the mating openings 410 when the latching element 426 is rotated to the first, closed position 466.

A dislodging element 474 is provided. The dislodging element 474 has a cross-section 478 greater that the first predetermined cross-section 70, and is capable of fitting slidably within the mating openings 410 in the securing latch 378. The dislodging element 474 is fixedly attached to the flexible cable 366 at a point 482 where the dislodging element 474 will pass through the mating openings 410 of the securing latch 378 when the cable 366 is withdrawn from the helmet 10. The dislodging element 474 bears upon the unfastening protrusion 470 as the cable 366 is withdrawn from the helmet 10, thereby causing the latching element 426 to pivot upwardly to a second, open position 486 dislodging the resilient engaging finger 458 from the receiving notch 462. This permits the first portion 382 of the securing latch 378 to be separated from the second portion 386 and the front portion 18 of the helmet 10 to be separated from the rear portion 22.

Figure 12:
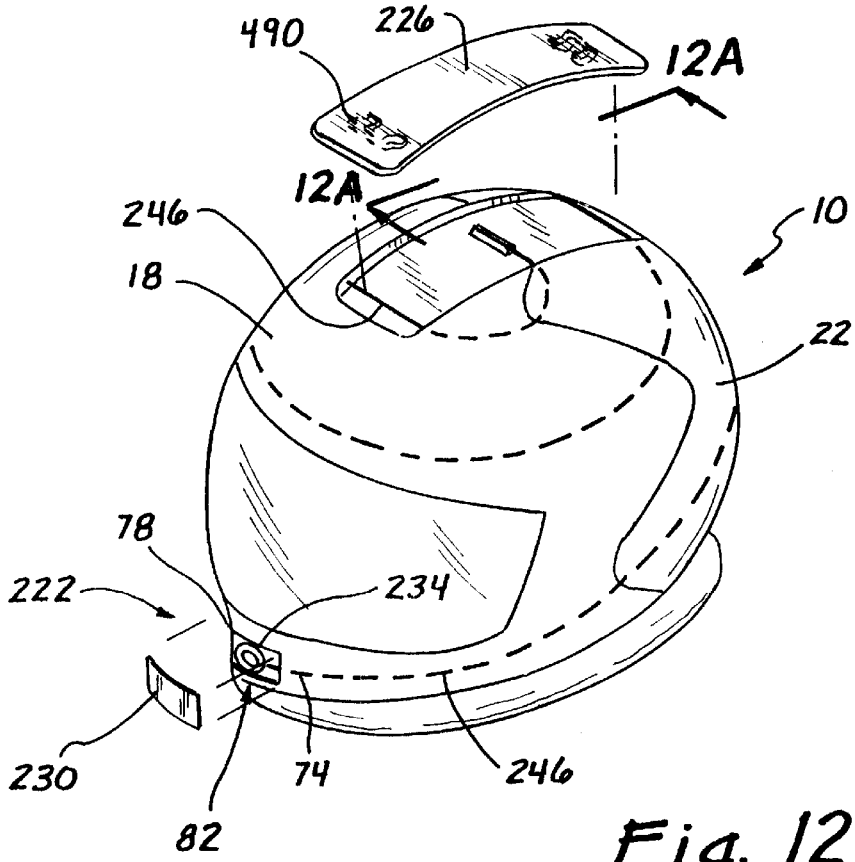
FIG. 12 is an exploded perspective view of the FIG. 8 embodiment illustrating the first and second removable access panels.
Figure 16:
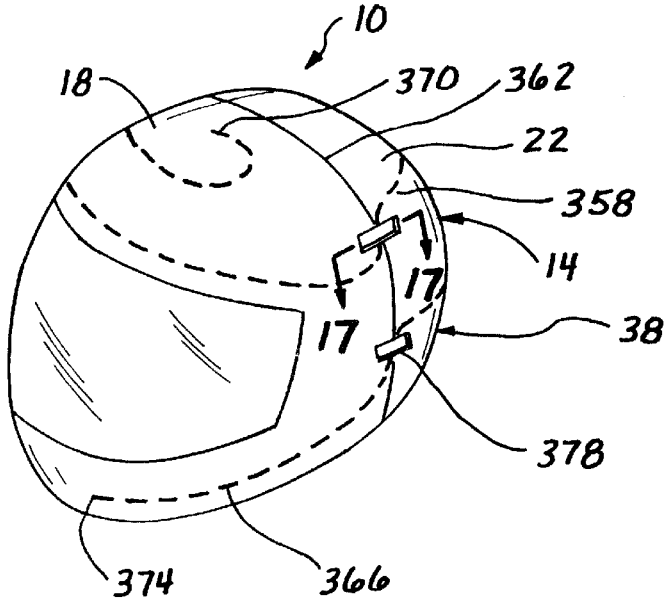
FIG. 16 is a detailed perspective view of a second alternative means for attaching the first end of the cable to the helmet.
Figure 12A:
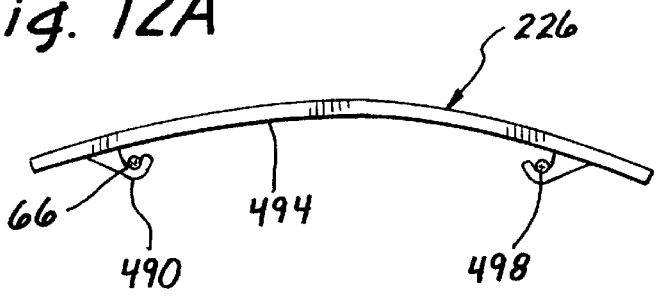
FIG. 12A is a side view of a first embodiment of the first access panel illustrating tensioning elements.
Figure 12B:
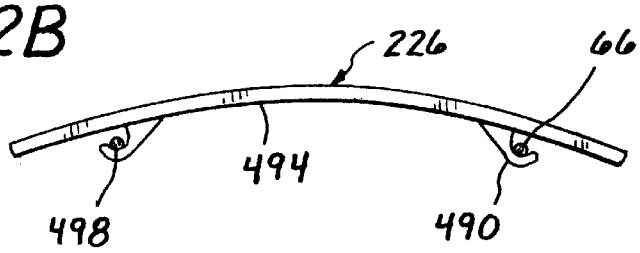
FIG. 12B is a side view of a second embodiment of the first access panel illustrating alternate tensioning elements.
Figure 12C:
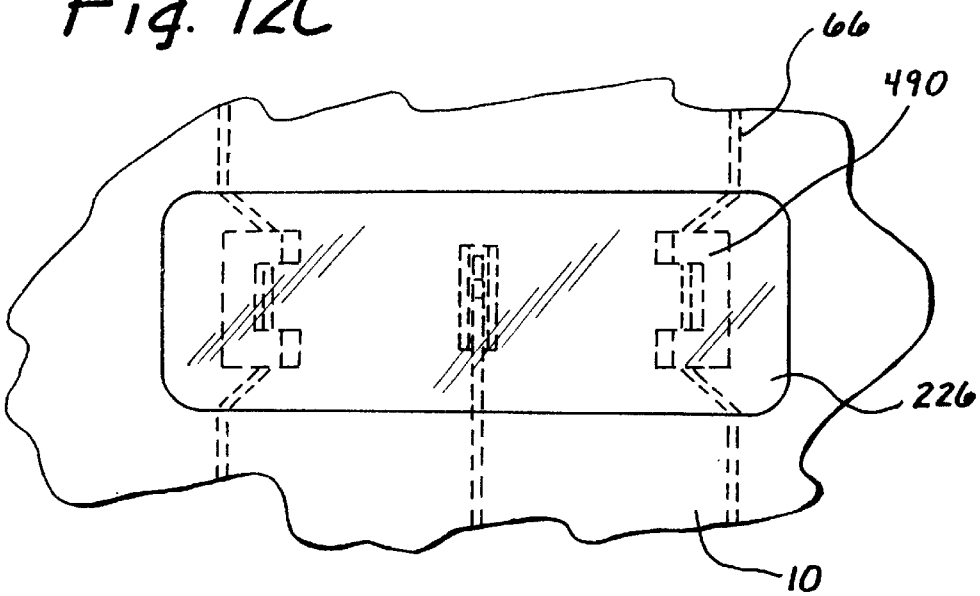
FIG. 12C is a plan view of a first embodiment of the first access panel illustrating tensioning elements, the flexible cable and the means for retaining the second end of the flexible cable.

In a final variant of the invention, as shown in FIG. 12, the first removable access panel 226 further includes at least one tensioning element 490. The tensioning element 490 is attached to an underside 494 of the first access panel 226 and is sized, shaped and located to engage a portion 498 of the flexible cable 66. The tensioning element 490 imparts tension to the cable 66 while securing the first access panel 226 to the helmet 10.

The two piece helmet with optional airbag 10 has been described with reference to particular embodiments. Other modifications and enhancements can be made without departing from the spirit and scope of the claims that follow.

What is claimed is:

1. A helmet, comprising:

a rigid, outer shell, said outer shell comprising a front portion and a mating rear portion, each of said front and rear portions having a lower surrounding edge;

said front portion including an opening to provide forward visibility for a wearer;

a resilient, padded inner liner, said liner comprising a first portion and a mating second portion;

said first portion being sized and shaped to fit within the front portion of the outer shell;

said second portion being sized and shaped to fit within the rear portion of the outer shell;

means for securing the helmet to the head of the wearer;

means for removably attaching said front portion to said rear portion comprising:

a series of mating orifices in said front portion and in said rear portion, said orifices being disposed adjacent an intersection between said front portion and said rear portion;

a flexible cable, said cable having a first predetermined cross-section, a first end and a second end and being sized and shaped to fit slidably through said mating orifices;

said cable being threaded through said mating orifices and securing said front portion to said rear portion;

means for removably attaching said first end to said second end;

means for withdrawing said cable from said mating orifices; and whereby, when said first end of said cable is detached from said second end, the cable may be withdrawn from the mating orifices and the front portion separated from the rear portion.

2. A helmet, as described in claim 1, wherein the means for removably attaching the first end of the cable to the second end further comprises:

first and second cable terminators, each of said cable terminators having a first end, a second end and a cross-section no larger than said first predetermined cross-section;

said first cable terminator being fixedly attached at its first end to the first end of the flexible cable;

said second cable terminator being fixedly attached at its first end to the second end of the flexible cable;

each of the second ends of said first and second cable terminators including a notch;

a retaining clip, said retaining clip being formed of rigid material, having a U-shaped cross-section, being sized and shaped to fit frictionally over said cable terminators and including a pair of protruding tabs, said tabs being sized, shaped, and disposed to removably engage the notches in the second ends of said terminators; and whereby, when the second ends of the first and second cable terminators are placed adjacent each other and the retaining clip is pressed downwardly over the terminators, with the protruding tabs engaging the notches in the second ends of the cable terminators, the first and second cable ends will be removably attached.

3. A helmet, as described in claim 1, wherein the means for removably attaching the first end of the cable to the second end further comprises:

first and second cable terminators, each of said cable terminators having a first end, a second end and a cross-section no larger than said first predetermined cross-section;

said first cable terminator being fixedly attached at its first end to the first end of the flexible cable;

said second cable terminator being fixedly attached at its first end to the second end of the flexible cable;

each of the second ends of said first and second cable terminators including a central stem and a securing portion attached to said stem;

a retaining clip, said retaining clip being formed of rigid material, having a U-shaped cross-section, being sized and shaped to fit frictionally over said cable terminators and including a two pair of protruding tabs, said tabs being sized, shaped, and disposed to removably surround the central stems of the second ends of the cable terminators, drawing the securing portions of said terminators together; and whereby, when the second ends of the first and second cable terminators are placed adjacent each other and the retaining clip is pressed downwardly over the terminators, with the protruding tabs surrounding the central stems of the second ends of the cable terminators, the first and second cable ends will be removably attached.

4. A helmet, as described in claim 1, wherein the means for removably attaching the first end of the cable to the second end further comprises:

an adhesive container, said container being sized and shaped to constrain the first end of the cable in close proximity to the second end of the cable;

an adhesive, said adhesive being poured into the adhesive container and over the first and second ends of the cable and allowed to dry; and whereby, when said adhesive has dried, the first and second ends of the cable will be removably attached until sufficient tension is directed to separate the first end of the cable from the second end of the cable and the adhesive fails to grip either of the first and second ends of the cable.

5. A helmet, as described in claim 1, wherein the means for removably attaching the front portion to the rear portion further comprises:

a series of mating, overlapping panels, said overlapping panels being fixedly attached to said front portion and said rear portion adjacent the intersection between said front and rear portions; and whereby, said mating, overlapping panels serve to increase structural strength of the helmet and provide improved weather sealing.

6. A helmet, as described in claim 5, wherein the first and mating second portions of the resilient, padded inner liner further comprise mating, interlocking edges, thereby providing improved weather sealing.

7. A helmet, as described in claim 1, further comprising means for rapidly removing the flexible cable to separate the front portion of the helmet from the rear portion.

8. A helmet, as described in claim 7 wherein the means for rapidly removing the flexible cable further comprises:

a first removable access panel, said first access panel covering the means for removably attaching the first end of the cable to the second end; and a second removable access panel, said second access panel covering a portion of the flexible cable and an indentation in one of the front and rear portions of the helmet, said indentation providing means to apply tension to the cable for its removal.

9. A helmet as described in claim 8 wherein said first removable access panel further comprises:

at least one tensioning element, said tensioning element being attached to an underside of said first access panel and being sized, shaped and disposed to engage a portion of said flexible cable; and said tensioning element imparting tension to said cable while securing said first access panel to the helmet.

10. A helmet, comprising:

a rigid, outer shell, said outer shell comprising a front portion and a mating rear portion, each of said front and rear portions having a lower surrounding edge;

said front portion including an opening to provide forward visibility for a wearer;

a resilient, padded inner liner, said liner comprising a first portion and a mating second portion;

said first portion being sized and shaped to fit within the front portion of the outer shell;

said second portion being sized and shaped to fit within the rear portion of the outer shell;

means for securing the helmet to the head of the wearer;

means for removably attaching said front portion to said rear portion comprising:

a series of mating orifices in said front portion and in said rear portion, said orifices being disposed adjacent an intersection between said front portion and said rear portion;

a flexible cable, said cable having a first predetermined cross-section, a first end and a second end and being sized and shaped to fit slidably through said mating orifices;

said cable being threaded through said mating orifices and securing said front portion to said rear portion;

means for removably attaching said first end to either of the front and rear portions of said rigid, outer shell comprising:

a cable terminator, said cable terminator having a first end, a second end and a cross-section no larger than said first predetermined cross-section;

said cable terminator being fixedly attached at its first end to the first end of the flexible cable;

the second end of said cable terminator including a notch;

a retaining clip, said retaining clip having a first end and a second end and being fixedly attached at its first end to the rigid outer shell;

said retaining clip being formed of rigid material, having a U-shaped cross-section, being sized and shaped to fit frictionally about said cable terminator and including a pair of protruding tabs, said tabs being sized, shaped, and disposed to removably engage the notch in the second end of said terminator;

means for applying tension to said second end and withdrawing said cable from said mating orifices;

whereby, when the cable terminator is pressed into the second end of the retaining clip, with the protruding tabs engaging the notch in the second ends of the cable terminator, the first end of the cable will be removably attached to the shell; and whereby, when said first end of said cable is detached from said shell, the cable may be withdrawn from the mating orifices and the front portion separated from the rear portion.

11. A helmet, comprising:

a rigid, outer shell, said outer shell comprising a front portion and a mating rear portion, each of said front and rear portions having a lower surrounding edge;

said front portion including an opening to provide forward visibility for a wearer;

a resilient, padded inner liner, said liner comprising a first portion and a mating second portion;

said first portion being sized and shaped to fit within the front portion of the outer shell;

said second portion being sized and shaped to fit within the rear portion of the outer shell;

means for securing the helmet to the head of the wearer;

means for removably attaching said front portion to said rear portion comprising:

a series of mating orifices in said front portion and in said rear portion, said orifices being disposed adjacent an intersection between said front portion and said rear portion;

a flexible cable, said cable having a first predetermined cross-section, a first end and a second end and being sized and shaped to fit slidably through said mating orifices;

said cable being threaded through said mating orifices and securing said front portion to said rear portion;

means for removably attaching said first end to either of the front and rear portions of said rigid, outer shell comprising:

a cable terminator, said cable terminator having a first end, a second end and a cross-section no larger than said first predetermined cross-section;

said cable terminator being fixedly attached at its first end to the first end of the flexible cable;

the second end of said cable terminator including a central stem and a securing portion attached to said stem;

a retaining clip, said retaining clip having a first end and a second end and being fixedly attached at its first end to the rigid outer shell;

said retaining clip being formed of rigid material, having a U-shaped cross-section, being sized and shaped to fit frictionally about said cable terminator and including a pair of protruding tabs, said tabs being sized, shaped, and disposed to removably surround the central stem of the second end of the cable terminator;

means for applying tension to said second end and withdrawing said cable from said mating orifices;

whereby, when the cable terminator is pressed into the second end of the retaining clip, with the protruding tabs surrounding the central stem of the second end of the cable terminator, the first end of the cable will be removably attached to the shell; and whereby, when said first end of said cable is detached from said shell, the cable may be withdrawn from the mating orifices and the front portion separated from the rear portion.

12. A helmet, comprising:

a rigid, outer shell, said outer shell comprising a front portion and a mating rear portion, each of said front and rear portions having a lower surrounding edge;

said front portion including an opening to provide forward visibility for a wearer;

a resilient, padded inner liner, said liner comprising a first portion and a mating second portion;

said first portion being sized and shaped to fit within the front portion of the outer shell;

said second portion being sized and shaped to fit within the rear portion of the outer shell;

means for securing the helmet to the head of the wearer;

means for removably attaching said front portion to said rear portion comprising:

a series of mating orifices in said front portion and in said rear portion, said orifices being disposed adjacent an intersection between said front portion and said rear portion;

a flexible cable, said cable having a first predetermined cross-section, a first end and a second end and being sized and shaped to fit slidably through said mating orifices;

said cable being threaded through said mating orifices and securing said front portion to said rear portion;

means for removably attaching said first end to either of the front and rear portions of said rigid, outer shell comprising:

an adhesive container, said container having a first end and a second end and being fixedly attached at its first end to the rigid, outer shell;

the second end of said container being sized and shaped to constrain the first end of the cable;

an adhesive, said adhesive being poured into the second end of the adhesive container and over the first end of the cable and allowed to dry;

means for applying tension to said second end and withdrawing said cable from said mating orifices;

whereby, when said adhesive has dried, the first end of the cable will be removably attached to the rigid, outer shell until sufficient tension is directed to second end of the cable to separate the first end of the cable from the adhesive container, thereby permitting removal of the cable from the helmet; and whereby, when said first end of said cable is detached from said shell, the cable may be withdrawn from the mating orifices and the front portion separated from the rear portion.

13. A helmet, as described in either claim 10, 11, or 12, further comprising means for rapidly removing the flexible cable to separate the front portion of the helmet from the rear portion.

14. A helmet, as described in claim 13 wherein the means for rapidly removing the flexible cable further comprises:

a first removable access panel, said first access panel covering the means for removably attaching the first end of the cable to the to the rigid outer shell; and a second removable access panel, said second access panel covering the second end of the flexible cable and a means to apply tension to the cable for its removal.

15. A helmet as described in claim 14 wherein said first removable access panel further comprises:

at least one tensioning element, said tensioning element being attached to an underside of said first access panel and being sized, shaped and disposed to engage a portion of said flexible cable; and said tensioning element imparting tension to said cable while securing said first access panel to the helmet.

16. A helmet, comprising:

a rigid, outer shell, said outer shell comprising a front portion and a mating rear portion, each of said front and rear portions having a lower surrounding edge;

said front portion including an opening to provide forward visibility for a wearer;

means for removably attaching said front portion to said rear portion comprising:

a series of mating orifices in said front portion and in said rear portion, said orifices being disposed adjacent an intersection between said front portion and said rear portion;

a flexible cable, said cable having a first predetermined cross-section, a first end and a second end and being sized and shaped to fit slidably through said mating orifices;

at least one securing latch, said securing latch having a first portion, a mating second portion and means for removably attaching said first portion to said second portion, thereby securing said front portion to said rear portion;

said first portion having an inner end and an outer end and being fixedly attached to the front portion of the shell;

said second portion having an inner end and an outer end and being fixedly attached to the rear portion of the shell;

said first and second portions including mating openings that are collinear when the first portion is disposed adjacent the second portion;

said cable being threaded through said mating orifices and said mating openings;

said cable including means for unfastening the means for removably attaching the first portion of the securing latch to the second portion;

means for removably attaching the first end of the cable to the rigid shell;

means for withdrawing the cable from said mating orifices and the mating openings;

a resilient, padded inner liner, said liner comprising a first portion and a mating second portion;

said first portion being sized and shaped to fit within the front portion of the outer shell;

said second portion being sized and shaped to fit within the rear portion of the outer shell;

means for securing the helmet to the head of the wearer; and whereby, when the first end of the cable is detached from the rigid shell, the cable may be withdrawn from the mating orifices and the mating openings, thereby unfastening the means for removably attaching the first portion of the securing latch to the second portion and the front portion of the helmet to be separated from the rear portion.

17. A helmet, as described in claim 16, wherein the means for removably attaching the first portion of the securing latch to the second portion and the means for unfastening the means for removably attaching the first portion of the securing latch to the second portion further comprise:

a pivot pin, said pivot pin being fixedly attached to said second portion between its inner end and its outer end perpendicular to a long axis of said second portion;

a latching element, said latching element having a first end, a second end, a first edge, a second edge, a top surface, a bottom surface and an orifice extending from said first edge to said second edge;

said latching element being rotatably mounted at said orifice to said pivot pin;

a resilient engaging finger, said finger extending downwardly from the bottom surface of said latching element;

a receiving notch, said notch being disposed in said first portion between its inner end and its outer end so as to frictionally engage said resilient finger when the latching element is rotated to a first, closed position;

an unfastening protrusion, said protrusion extending downwardly from the bottom surface of said latching element and being disposed to obscure a portion of the mating openings when the latching element is rotated to the first, closed position;

a dislodging element, said dislodging element having a cross-section greater that the first predetermined cross-section, being capable of fitting slidably within the mating openings in the securing latch and being fixedly attached to the flexible cable at a point where the dislodging element will pass through the mating openings of the securing latch when the cable is withdrawn from the helmet;

said dislodging element bearing upon the unfastening protrusion as the cable is withdrawn from the helmet, thereby causing the latching element to pivot upwardly to a second, open position and dislodging the resilient engaging finger from the receiving notch, permitting the front portion of the securing latch to be separated from the rear portion and the front portion of the helmet to be separated from the rear portion.

* * * * *